US011433528B1

(12) United States Patent
Crom

(10) Patent No.: US 11,433,528 B1
(45) Date of Patent: Sep. 6, 2022

(54) PORTABLE WORK BENCH

(71) Applicant: Christopher Crom, Spokane, WA (US)

(72) Inventor: Christopher Crom, Spokane, WA (US)

( * ) Notice: Subject to any disclaimer, the term of this patent is extended or adjusted under 35 U.S.C. 154(b) by 366 days.

(21) Appl. No.: 16/821,508

(22) Filed: Mar. 17, 2020

Related U.S. Application Data

(60) Provisional application No. 62/907,573, filed on Sep. 28, 2019.

(51) Int. Cl.
*B25H 1/04* (2006.01)
*B25H 1/00* (2006.01)

(52) U.S. Cl.
CPC ..... *B25H 1/04* (2013.01); *B25H 1/0035* (2013.01)

(58) Field of Classification Search
CPC ..... B25H 1/04; B25H 1/0035; B25H 1/00; B25H 1/0064; B25H 1/102; B25H 3/00; B23Q 3/00; B23Q 3/06; B23Q 3/10
USPC ..... 144/286.5; 269/136–138, 17, 16, 291; 29/281.1
See application file for complete search history.

(56) References Cited

U.S. PATENT DOCUMENTS 5,819,671 A * 10/1998 Ocampo ..... B23D 47/025 108/65
8,864,149 B2 * 10/2014 Stryker ..... B62B 3/005 280/47.35
10,888,193 B2 * 1/2021 Dahle ..... A47J 37/0704
2002/0096845 A1 * 7/2002 Spann ..... A61G 12/001 280/79.2

* cited by examiner

*Primary Examiner* — Joseph J Hail
*Assistant Examiner* — Caleb Andrew Holizna
(74) *Attorney, Agent, or Firm* — Gulf Coast Intellectual Property Group

(57) ABSTRACT

A portable work bench that is configured to be transitioned from a folded position to a deployed position. The portable work bench of the present invention includes a frame wherein the frame includes a first set of vertical support members and a second set of vertical support members. A pair of opposing upper support members are superposed the first vertical support members and second vertical support members. A work bench surface member is secured to the upper support members. The work bench surface member further includes a pair of opposing board support members on opposing ends thereof. The portable work bench includes a first set of extension members and a second set of extension members extending outward from opposing side of the frame. The first set of extension members second set of extension members each have a void operable to have releasably secured therein a receptacle.

7 Claims, 2 Drawing Sheets

PORTABLE WORK BENCH

PRIORITY UNDER 35 U.S.C. SECTION 119(E) & 37 C.F.R. SECTION 1.78

This nonprovisional application claims priority based upon the following prior U.S. Provisional Patent Application entitled: Portable Work Bench, Application No.: 62/907,573 filed Sep. 28, 2019, in the name of Christopher Crom, which is hereby incorporated by reference for all purposes.

FIELD OF THE INVENTION

The present invention relates generally to construction and project apparatus, more specifically but not by way of limitation a workbench that is configured to be portable and transition between a working position and a folded position.

BACKGROUND

As is known in the art, there are numerous types of workbenches that are configured to provide suitable surfaces for a variety of tasks. Some workbenches are configured for specific tasks such as but not limited to metal and are often configured with a suitable top manufactured of steel or similar material. Other workbenches are configured for other general tasks such as but not limited to woodworking or general construction. These workbenches are typically configured with a hardwood surface and can further include frames that may be operable to provide storage and/or retention of various items to include but not limited to tools. While many of these workbenches provide significant value, they are typically limited to a shop or other facility as conventional workbenches are not designed to provide portability.

One issue with conventional workbenches is their inability to provide either a portable feature or be configured to be stored in a folded position. Most workbenches have a rigid frame and are not designed to be operably moved intermediate a stored and working position. The aforementioned deficiency with the frame results in either the inability to install a workbench due to lack of space or diminish the available square footage and as such a potential optimal utilization of space. Additionally, most portable workbenches lack the required elements to assist an individual with a desired task. Shortcomings such as lack of specialized storage or sufficient work surfaces are present in existing technology of portable workbenches.

It is intended within the scope of the present invention to provide a portable workbench that is configured to be transitioned between a stored position and a deployed position wherein the workbench is further configured to be portable and provide work surfaces along with storage compartments.

SUMMARY OF THE INVENTION

It is the object of the present invention to provide a portable workbench that is configured to have a first position and a second position wherein in the first position the portable workbench of the present invention is in a folded position for storage.

Another object of the present invention is to provide a portable workbench that is operable to provide both storage and a work surface wherein in the second position the portable workbench is deployed for use.

A further object of the present invention is to provide a portable workbench that is configured to have a first position and a second position wherein the portable workbench includes a frame wherein the frame includes vertical support members and horizontal support members.

Still another object of the present invention is to provide a portable workbench that is operable to provide both storage and a work surface wherein the vertical support members further include l-channel shaped supports secured thereto on opposing sides of the frame.

An additional object of the present invention is to provide a portable workbench that is configured to have a first position and a second position wherein the portable workbench further includes a lower support shelf operably coupled intermediate opposing vertical support members and secured to the 1-shaped channel supports.

Yet a further object of the present invention is to provide a portable workbench that is operable to provide both storage and a work surface wherein the vertical support members include extension support members extending outward from the frame.

Another object of the present invention is to provide a portable workbench that is configured to have a first position and a second position wherein the extension support members are present on opposing sides of the frame and are configured to releasably secure storage compartments.

An alternate object of the present invention is to provide a portable workbench that is operable to provide both storage and a work surface that further includes an upper support member that is a portion of the frame wherein the vertical support members are hingedly secured to the upper support member.

Still a further object of the present invention is to provide a portable workbench that is configured to have a first position and a second position wherein the vertical support members are secured into position in the second position of the portable workbench utilizing a locking mechanism.

An additional object of the present invention is to provide a portable workbench that is operable to provide both storage and a work surface that further includes wheels on the rear vertical support members.

A further object of the present invention is to provide a portable workbench that is configured to have a first position and a second position that further includes replaceable border support members superposed to the upper surface of the frame and the workbench surface.

An alternative objective of the present invention is to provide a portable workbench that is operable to provide both storage and a work surface wherein the frame is manufactured from square metal tubing in a preferred embodiment.

Yet a further object of the present invention is to provide a portable workbench that is configured to have a first position and a second position wherein the storage compartments in the preferred embodiment are configured to have a volume of approximately twelve gallons.

An alternative object of the present invention is to provide a portable workbench that is operable to provide both storage and a work surface wherein an extension support member is present adjacent to one of the storage compartments distal to the frame.

Still another object of the present invention is to provide a portable workbench that is configured to have a first position and a second position wherein a portion of the frame is secured via suitable techniques such as but not limited to welding.

To the accomplishment of the above and related objects the present invention may be embodied in the form illustrated in the accompanying drawings. Attention is called to the fact that the drawings are illustrative only. Variations are contemplated as being a part of the present invention, limited only by the scope of the claims.

BRIEF DESCRIPTION OF THE DRAWINGS

A more complete understanding of the present invention may be had by reference to the following Detailed Description and appended claims when taken in conjunction with the accompanying Drawings wherein:

DETAILED DESCRIPTION

Figure 1:
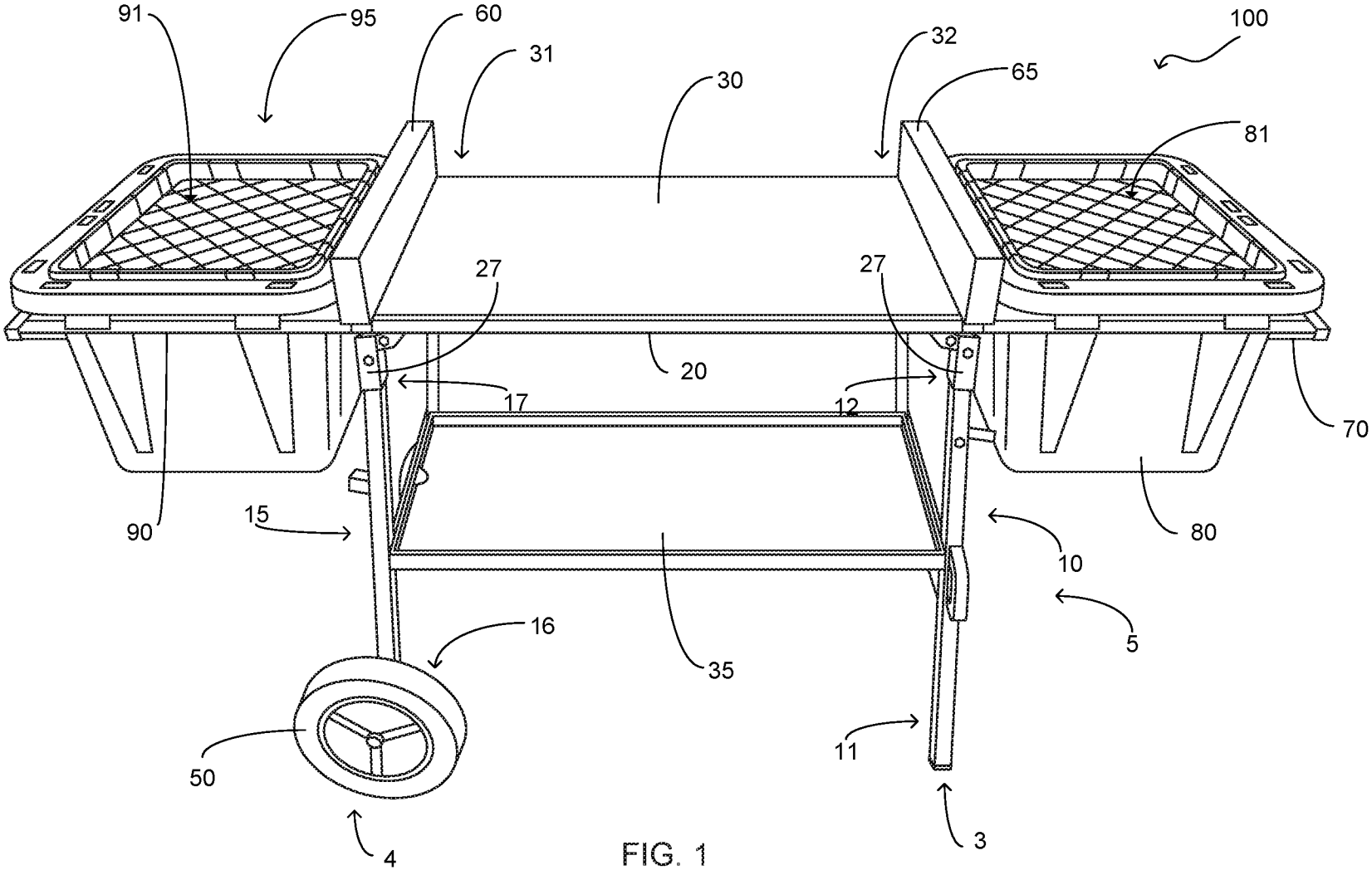
FIG. 1 is a perspective view of the preferred embodiment of the present invention.
Figure 2:
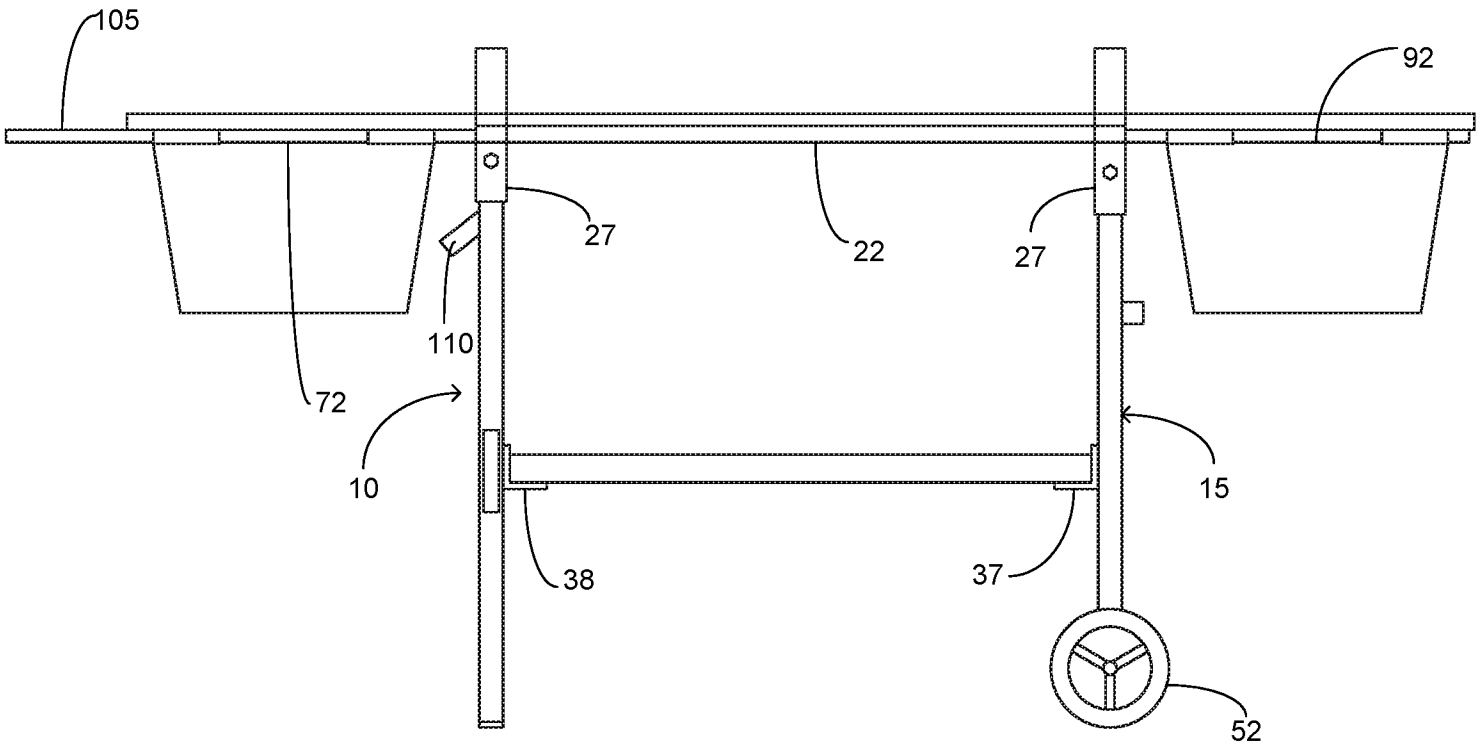
FIG. 2 is a side diagrammatic view of the present invention.

Referring now to the drawings submitted herewith, wherein various elements depicted therein are not necessarily drawn to scale and wherein through the views and figures like elements are referenced with identical reference numerals, there is illustrated a portable work bench 100 constructed according to the principles of the present invention.

An embodiment of the present invention is discussed herein with reference to the figures submitted herewith. Those skilled in the art will understand that the detailed description herein with respect to these figures is for explanatory purposes and that it is contemplated within the scope of the present invention that alternative embodiments are plausible. By way of example but not by way of limitation, those having skill in the art in light of the present teachings of the present invention will recognize a plurality of alternate and suitable approaches dependent upon the needs of the particular application to implement the functionality of any given detail described herein, beyond that of the particular implementation choices in the embodiment described herein. Various modifications and embodiments are within the scope of the present invention.

It is to be further understood that the present invention is not limited to the particular methodology, materials, uses and applications described herein, as these may vary. Furthermore, it is also to be understood that the terminology used herein is used for the purpose of describing particular embodiments only, and is not intended to limit the scope of the present invention. It must be noted that as used herein and in the claims, the singular forms "a", "an" and "the" include the plural reference unless the context clearly dictates otherwise. Thus, for example, a reference to "an element" is a reference to one or more elements and includes equivalents thereof known to those skilled in the art. All conjunctions used are to be understood in the most inclusive sense possible. Thus, the word "or" should be understood as having the definition of a logical "or" rather than that of a logical "exclusive or" unless the context clearly necessitates otherwise. Structures described herein are to be understood also to refer to functional equivalents of such structures. Language that may be construed to express approximation should be so understood unless the context clearly dictates otherwise.

References to "one embodiment", "an embodiment", "exemplary embodiments", and the like may indicate that the embodiment(s) of the invention so described may include a particular feature, structure or characteristic, but not every embodiment necessarily includes the particular feature, structure or characteristic.

Referring now to the Figures submitted herewith, the portable work bench 100 includes a frame 5. The frame 5 is manufactured from a suitable durable material such as but not limited to square metal tubing. The frame 5 as will be further discussed herein is configured to be operably transitioned intermediate a first position and a second position. In the first position, the frame 5 is folded for storage and in the second position the frame 5 is deployed, as illustrated herein for use by a user. The frame 5 includes a first set of vertical support members 10 and a second set of vertical support member 15. The first set of vertical support members 10 and second set of vertical support members 15 are constructed from square metal tubing and are manufactured from the same length. The first set of vertical support members 10 include a lower end 11 and an upper end 12. The second set of vertical support members includes a lower end 16 and upper end 17. The upper ends 12,17 are operably secured to the upper support members 20,22 utilizing suitable durable techniques. As is further discussed herein, the upper support members 20, 22 provide the support structure for the workbench surface member 30.

The first set of vertical support members 10 and second set of vertical support members 15 are foldably secured to the upper support members 20,22 utilizing fasteners 27. It is contemplated within the scope of the present invention that the fasteners 27 could be embodied from numerous types of fasteners that are configured to facilitate the folding of the first set of vertical support members 10 and second set of vertical support members 15. The fasteners 27 facilitate the first position and the second position of the frame 5. In the first position the first set of vertical support members 10 and second set of vertical support members 15 are substantially parallel and adjacent to the upper support members 20,22. In the second position, the frame 5 is configured wherein the first set of vertical support members 10 and second set of vertical support members 15 are substantially perpendicular to the upper support members 20,22 and as such placing the portable work bench 100 in a ready to use position. It is contemplated within the scope of the present invention that the fasteners 27 could be configured in various different manners so as to accomplish the desired objective stated herein.

Operably disposed between the first set of vertical support members 10 and second set of vertical support members 15 is the lower support shelf member 35. The lower support shelf member 35 is manufactured from a suitable rigid material such as but not limited to MDF board and is rectangular in shape. The lower support shelf member 35 is releasably secured and placed in position ensuing the frame 5 being moved to its second position. The lower support shelf member 35 is held in position utilizing support members 37,38. Support members 37,38 are secured to the first set of vertical support members 10 and second set of vertical support members 15 and are secured utilizing suitable durable techniques such as but not limited to welding. The support members 37, 38 in a preferred embodiment are L-shaped so as to engage and support the lower support shelf member 35. While the support members 37, 38 are L-shaped in a preferred embodiment, it is contemplated within the scope of the present invention that the support members 37, 38 could be formed in alternate shapes and achieve the desired objective stated herein.

The second set of vertical support members 15 have wheels 50,52 secured to the lower end 16 thereof. The wheels 50,52 are secured utilizing suitable techniques and are operable to provide movement of the portable work bench 100 in its second position. While no particular size of wheels 50,52 are required, in a preferred embodiment of the present invention, the wheels 50,52 are eight inches in diameter.

The workbench surface member 30 is superposed the frame 5 and secured thereto utilizing suitable fasteners such as but not limited to screws. The workbench surface member 30 is manufactured from a durable rigid material such as but not limited to MDF board and is generally rectangular in shape. The workbench surface member 30 includes a first end 31 and second end 32. Superposed the workbench surface member 30 proximate first end 31 and second end 32 are border support members 60,65. The border support members 60,65 are releasably secured utilizing screws or other suitable fasteners. The border support members 60,65 are manufactured from wood or other suitable material and in a preferred embodiment are two by four wood. The border support members 60,65 are designed to be replaceable in the event of being damaged as a result of any work being performed on the portable work bench 100.

The frame 5 further includes a first set of extension support members 70,72 that are operably secured to the first side 3 of the frame 5. The first set of extension support members 70,72 are substantially aligned with the upper support members 20, 22 and extend outward from the first side 3 of the frame 5. The first set of extension members 70,72 has operably coupled therebetween a first storage receptacle 80. The first storage receptacle 80 is releasably suspended intermediate the first set of extension members 70,72. The first storage receptacle 80 is manufactured from a suitable material such as but not limited to plastic and has an interior volume 81 configured to receive and store desired objects. It is contemplated within the scope of the present invention that the first storage receptacle 80 could be provided in alternate sizes. Furthermore, it is contemplated within the scope of the present invention that more than one first storage receptacle 80 could be operably coupled intermediate the first set of extension members 70,72.

The frame 5 further includes a second set of extension support members 90,92 that are operably secured to the second side 4 of the frame 5. The second set of extension support members 90,92 are substantially aligned with the upper support members 20, 22 and extend outward from the second side 4 of the frame 5. The second set of extension support members 90,92 are slidably configured so as to provide a variable extension distance outward from the second side 4 of the frame 5. The second set of extension members 90,92 has operably coupled therebetween a second storage receptacle 95. The second storage receptacle 95 is releasably suspended intermediate the second set of extension members 90,92. The second storage receptacle 95 is manufactured from a suitable material such as but not limited to plastic and has an interior volume 91 configured to receive and store desired objects. It is contemplated within the scope of the present invention that the second storage receptacle 95 could be provided in alternate sizes. Furthermore, it is contemplated within the scope of the present invention that more than one second storage receptacle 95 could be operably coupled intermediate the second set of extension members 90,92.

The portable work bench 100 further includes handle 105. Handle 105 is slidably secured to the first set of extension members 70,72. The handle 105 is manufactured from a suitable rigid material such as but not limited to square metal tubing. The handle 105 extends outward from the first set of extension members 70,72 so as to provide leverage to lift the first side 3 of the frame 5 allowing a user to move the portable work bench 100 on wheels 50,52. It is contemplated within the scope of the present invention that the handle 105 could be manufactured in various lengths and that it is slidably coupled utilizing suitable techniques.

The frame 5 further includes locking member 110. Locking member 110 is operable to secure the frame 5 in its second position. It should be understood within the scope of the present invention that the locking member 110 could be manufactured from various suitable fasteners. Additionally, it should be understood within the scope of the present invention that the frame 5 could have alternate quantities of locking members 110.

In the preceding detailed description, reference has been made to the accompanying drawings that form a part hereof, and in which are shown by way of illustration specific embodiments in which the invention may be practiced. These embodiments, and certain variants thereof, have been described in sufficient detail to enable those skilled in the art to practice the invention. It is to be understood that other suitable embodiments may be utilized and that logical changes may be made without departing from the spirit or scope of the invention. The description may omit certain information known to those skilled in the art. The preceding description is, therefore, not intended to be limited to the specific forms set forth herein, but on the contrary, it is intended to cover such alternatives, modifications, and equivalents, as can be reasonably included within the spirit and scope of the invention.

What is claimed is:

1. A portable work bench wherein the portable work bench comprises:

a frame, said frame having a first side and a second side, said frame having a first set of vertical support members and a second set of vertical support members, said frame further having a pair of opposing upper support members, said upper support members being superposed said first set of vertical support members and said second set of vertical support members;

a work bench surface member, said work bench surface member being planar in manner, said work bench surface member providing a surface to execute tasks thereon;

opposing border support members, said opposing border support members being secured to opposing ends of said work bench surface member, said opposing border support members extending upward from said work bench surface member;

a lower shelf support member, said lower shelf support member being secured intermediate said first set of vertical support members and said second set of vertical support members, said lower shelf support member being beneath said work bench surface member;

at least one set of extension members, said at least one set of extension members operably coupled to said frame, said at least one set of extension members configured to extend outward from said frame, said at least one set of extension members configured to have at least one receptacle operably coupled therewith; and a handle, said handle being slidably coupled to said at least one set of extension members.

2. The portable work bench as recited in claim 1, wherein said first set of vertical support members and said second set of vertical support members further includes a pair of support members, said support members configured to have the lower shelf support member superposed thereon.

3. The portable work bench as recited in claim 2, and further including wheels, said wheels being secured to said second set of vertical support members.

4. A portable work bench wherein the portable work bench comprises:

a frame, said frame having a first side and a second side, said frame having a first set of vertical support members and a second set of vertical support members, said first set of vertical support members and said second set of vertical support members having an upper end and a lower end, said frame further having a pair of opposing upper support members, said opposing upper support members being superposed said upper end of said first set of vertical support members and said second set of vertical support members;

a work bench surface member, said work bench surface member being superposed to said opposing upper support members, said work bench surface having a first end and a second end, said work bench surface member being planar in manner, said work bench surface member having an upper surface operable to provide a surface to execute tasks thereon;

a first set of extension members, said first set of extension members operably coupled to said first side of said frame, said first set of extension members configured to extend outward from said frame;

a second set of extension members, said second set of extension members operably coupled to said second side of said frame, said second set of extension members configured to extend outward from said frame;

a lower shelf support member, said lower shelf support member being secured intermediate said first set of vertical support members and said second set of vertical support members, said lower shelf support member being beneath said work bench surface member;

a first border support member and a second border support member, said first border support member being secured to said first end of said work bench surface member, said second border support member being secured to said second end of said work bench surface member, said first border support member and said second border support member extending upward from said work bench surface member;

a handle, said handle being slidably secured to said first set of extension members; and at least one receptacle, said at least one receptacle operably coupled to said first set of extension members, said at least one receptacle having an interior volume to receive and store objects therein.

5. The portable work bench as recited in claim 4, wherein said second set of vertical support members include wheels secured to the lower end thereof.

6. A portable work bench comprising:

a frame, said frame having a first side and a second side, said frame having a first set of vertical support members and a second set of vertical support members, said first set of vertical support members and said second set of vertical support members having an upper end and a lower end, said frame further having a pair of opposing upper support members, said opposing upper support members being superposed said upper end of said first set of vertical support members and said second set of vertical support members, wherein said first set of vertical support members and said second set of vertical support members further includes a pair of support members, said support members configured to have the lower shelf support member superposed thereon;

a work bench surface member, said work bench surface member being superposed to said opposing upper support members, said work bench surface having a first end and a second end, said work bench surface member being planar in manner, said work bench surface member having an upper surface operable to provide a surface to execute tasks thereon;

a first set of extension members, said first set of extension members operably coupled to said first side of said frame, said first set of extension members configured to extend outward from said frame;

a second set of extension members, said second set of extension members operably coupled to said second side of said frame, said second set of extension members configured to extend outward from said frame;

a lower shelf support member, said lower shelf support member being secured intermediate said first set of vertical support members and said second set of vertical support members, said lower shelf support member being beneath said work bench surface member;

a first border support member and a second border support member, said first border support member being secured to said first end of said work bench surface member, said second border support member being secured to said second end of said work bench surface member, said first border support member and said second border support member extending upward from said work bench surface member;

a handle, said handle being slidably secured to said first set of extension members; and a plurality of receptacles, said plurality of receptacles operably coupled to said first set of extension members and said second set of extension members, said plurality of receptacles having an interior volume to receive and store objects therein.

7. The portable work bench as recited in claim 6, wherein said second set of vertical support members include wheels secured to the lower end thereof.

* * * * *